US005730200A

United States Patent [19]

Landua

[11] Patent Number: 5,730,200

[45] Date of Patent: Mar. 24, 1998

[54] DEVICE AND METHOD FOR GRIPPING A CASTING CORE IN PARTICULAR A SOLE CORE

[75] Inventor: Werner Landua, Mannheim, Germany

[73] Assignee: Adolf Hottinger Maschinenbau GmbH, Mannheim, Germany

[21] Appl. No.: 571,916

[22] PCT Filed: May 18, 1994

[86] PCT No.: PCT/DE94/00574

§ 371 Date: Dec. 29, 1995

§ 102(e) Date: Dec. 29, 1995

[87] PCT Pub. No.: WO95/01234

PCT Pub. Date: Jan. 12, 1995

[30] Foreign Application Priority Data

Jun. 29, 1993 [DE] Germany ..... 43 21 563.7
Jul. 3, 1993 [DE] Germany ..... 43 22 181.5

[51] Int. Cl.[6] ..... B22D 19/08; B22D 33/04

[52] U.S. Cl. ..... 164/98; 164/137; 164/333

[58] Field of Search ..... 164/137, 340, 164/332, 333, 98; 198/803.12, 803.7

[56] References Cited

U.S. PATENT DOCUMENTS

| | | | |
|---|---|---|---|
| 2,286,994 | 6/1942 | Nocar | 164/340 |
| 2,773,582 | 11/1956 | Denyssen et al. | 198/803.12 |
| 4,927,205 | 5/1990 | Bowler et al. | 198/803.12 |
| 5,156,255 | 10/1992 | Landua et al. . | |
| 5,322,300 | 6/1994 | Mistrater et al. | 198/803.7 |
| 5,324,049 | 6/1994 | Mistrater et al. | 198/803.7 |

FOREIGN PATENT DOCUMENTS

| | | | |
|---|---|---|---|
| 294 647 | of 0000 | Germany . | |
| 39 09 102 | 1/1990 | Germany . | |
| 41 02 568 | 7/1992 | Germany . | |
| 338 295 | 3/1970 | U.S.S.R. . | |
| 612374 | 11/1948 | United Kingdom | 164/340 |

*Primary Examiner*—Kuang Y. Lin
*Attorney, Agent, or Firm*—Bell Seltzer Intellectual Property Law Group of Alston & Bird LLP

[57] ABSTRACT

An apparatus for gripping and handling a casting core of the type used in the casting of metallic products and the like. The gripping apparatus includes a pair of gripping jaws which are adapted to enter an opening in the casting core and then be expanded to grip the inside of the opening with a predetermined or adjustable contact pressure. The jaws are also preferably adapted to the contour of the inside of the opening in a form-fitting manner, so as to avoid damage to the core.

14 Claims, 6 Drawing Sheets

DEVICE AND METHOD FOR GRIPPING A CASTING CORE IN PARTICULAR A SOLE CORE

BACKGROUND OF THE INVENTION

The present invention relates to an apparatus for gripping a casting core, in particular a sole core of the type having at least one recess, opening, passage, or the like, which is adapted to be engaged by the gripping apparatus. Furthermore, the invention relates to a method of gripping a casting core, in particular a sole core, with the use of the apparatus in accordance with the invention.

Generally the present invention relates to the field of casting practice. For casting molded pieces, in particular engine blocks, casting cores or molds are usually made separately, then combined and joined to one another to form a casting mold or a core assembly. To this end, it is necessary to move the individual cores, for example, sole cores and water-jacket cores for making an engine block, relative to one another, to stack same and, as the case may be, to join same with further structural components, before they may be filled with molten metal for making, for example, a metallic workpiece, such as an engine block.

Known from practice are apparatus for gripping casting cores, in particular within the scope of common transportation devices for casting cores and molds. To document this prior art, reference may be made, for example, to U.S. Pat. No. 5,156,255 and DE-OS 41 02 568, both being applicant's own published documents.

The known apparatus are so-called inside grippers which are used to engage in recesses in casting cores and molds, in particular in sole and water-jacket cores. These inside grippers are provided with clamping means in the form of a pressure chamber with an elastic outside wall, which is "inflated" hydraulically or pneumatically. Once inserted into the recess and activated, the outside wall of the inside gripper is pressed against the entire inside wall of the recess in the core, so as to permit the core to be raised as a result of the resulting frictional engagement.

However, the known inside grippers are problematic insofar as they press, within the recess, against the entire inside wall of the core, thereby presenting a considerable risk of damaging the core, in particular a thin sole core. Furthermore, the known inside grippers have only two operating conditions, namely a deactivated and an activated state, so that they do not permit an adjustment to different wall thicknesses or to sensitive characteristics of the core being gripped. Finally, hydraulically or pneumatically operating inside grippers require substantial sealing measures, the engaging outside walls of the inside grippers being mostly made of rubber or a rubberlike material. This material is subjected to very considerable wear.

It is therefore an object of the present invention to improve and further develop an apparatus for gripping or handling a casting core, in particular a sole core of the type described above, so that a simple construction permits automatic handling of cores, thereby preventing at least to a large extent damage to the cores and excessive wear on the gripping device.

Another object is to provide a method of gripping a casting core, in particular a sole core with the use of the apparatus of the present invention, it being possible, within the scope of this method to also combine in particular a sole core with a structural member that is to be assembled, such as a cylinder liner, and a further component, such as a water-jacket core.

SUMMARY OF THE INVENTION

The above and other objects and advantages of the present invention are achieved by the provision of a gripping apparatus which comprises a support housing, and gripping means including a pair of gripping jaws mounted to the support housing for being received in the opening of the casting core and for then pressing against the inside wall of the opening with a predetermined force and so as to grip the casting core.

It has been recognized by the present invention that a so-called inside gripping device may be constructed in a simple manner, in that the gripping means is made in the form of gripping jaws. As a result of this measure, the gripping force is not applied to the entirety of the inside wall of the core to be gripped, but rather the gripping jaws press against the inside wall of the core only in predetermined regions. The core is not pressed apart over its entire circumference, and the risk of damage is reduced quite considerably. Furthermore, the gripping jaws are constructed, preferably in form-fitting manner, i.e., they are adapted to the contour of the inside wall of the core or sole core. Assuming that sole core has a cylindrical recess or a cylindrical passage, the gripping jaws are constructed as circular segments with a corresponding radius, and they contact the inside wall of the core only in sections.

With respect to a particularly gentle and, thus, damage-preventing gripping of cores, it will be especially advantageous, when the contact pressure of the gripping jaws is predeterminable or adjustable. This very special measure permits an adjustment of the contact pressure, for example, with respect to the wall thickness of the core being gripped. Thin-walled and, thus, lightweight cores are clamped or gripped by applying correspondingly small contact pressures.

Specifically with respect to construction, it will be of advantage, when the gripping apparatus includes a cylinder-piston arrangement with an outwardly displaceable piston or an outwardly displaceable piston rod and with a clamping wedge fixed thereto and extending between the gripping jaws. In other words, the gripping jaws are actuated, or pushed apart in a direction toward the inside wall of the core or against the inside wall of the core by a clamping wedge that can be advanced between the gripping jaws. This clamping wedge is operatively connected with the cylinder-piston arrangement, so that the clamping wedge is moved as a result of a piston displacement. This cylinder-piston arrangement for moving the clamping wedge may operate hydraulically or pneumatically. In accordance with the controllable operation of the cylinder-piston arrangement as used in this instance, it is possible to predetermine or control the contact pressure of the gripping jaws by advancing the clamping wedge to a greater or lesser extent into the region between the gripping jaws.

In a further advantageous manner, the cylinder-piston arrangement, the clamping wedge, and the gripping jaws are accommodated in a support housing that can be moved into the opening of the core. With respect to its outside dimensions, the housing must be dimensioned such that it just fits into the opening of the core. Consequently, the gripping apparatus is adapted at least largely to the opening in a particular core. The gripping jaws acting upon the inside wall of the core may be displaced in the described embodiment through openings in the housing, preferably in a direction perpendicular to the direction of movement of the clamping wedge, by moving the clamping wedge outward. Essential in this connection is that, on the one hand, the contact surfaces between the clamping wedge and the gripping jaws and, on the other hand, the contact surfaces between the gripping jaws and the inside wall of the core be adapted to one another such that point contacts and thereby caused distortions are absent. To avoid any damage, it is necessary that the surfaces be in areal contact with each other.

In one advantageous embodiment of the gripping jaws, two diametrically opposed gripping jaws are provided for sliding movement in opposite directions to one another out of the housing and toward the inside wall of the core. As a result of this arrangement, the core is biased on opposite sides by a force or pressure, so that an overall deformation of the core is prevented. In the case of such oppositely directed gripping jaws, the deformation starting upon activation of the gripping jaws is unidirectional or uniaxial in its main components, so that the core having, for example, an annular cross section, is deformed at least slightly to an elliptic cross sectional configuration. However, it should be specifically noted that this deformation is always extremely slight, so that the core does not break in any event.

presuming a circular cross section of the opening in the core, the surface of the gripping jaws being used to contact the inside wall of the core may be made in the form of circular segments. Should the gripping jaws be permitted to tilt at least somewhat, same would be able to lie against the inside wall of the core in an optimal manner, so that a pointwise application of force is also avoided.

To prevent the gripping jaws from moving out entirely, for example in the case of breakage of the core being gripped, it is especially advantageous, when the gripping jaws can be pressed by means of the clamping wedge against a stop that limits the movement of the gripping jaws. This stop could be formed by an extension of the gripping jaws provided on their side facing away from the contact surface and by the inside wall of the housing, so that once the gripping jaws are fully moved out, the extension lies, from the inside, against the inside wall of the housing.

To effect a return of the gripping jaws to their initial position upon the retraction of the wedge, elastic return means may be provided. Alternatively, it is possible, for example, to make the clamping wedge or the gripping jaws of a magnetized material or of a ferromagnetic material, so as to permit the gripping jaws to retract under a magnetic action. In any event, it is especially advantageous that the gripping jaws retract entirely so that the entry of the gripping apparatus into the opening of the core will not be obstructed by projecting gripping jaws.

Finally, as regards the cooperation of the clamping wedge and the gripping jaws, it will be advantageous, when the clamping wedge rests with its wedge surfaces in form-fitting manner and displaceably against the gripping jaws on their side facing away from the contact surface. For a better displaceability, the wedge surfaces and/or the contact surfaces of the gripping jaws could be coated with a material preventing frictional engagement, i.e. a lubricant. Thus, for example, the surfaces may be provided with a silicon coating.

It will be highly advantageous, when the gripping apparatus to be moved into the opening of the core is initially centered in the opening, so as to avoid having an uneven force applied to the inside wall of the core. To this end, the gripping apparatus preferably is provided at its upper end with a shoulder formed thereon for contacting at the entry end the upper edge of the opening in the core and, thus, serving to center the apparatus or to limit its depth of penetration. With this shoulder, the apparatus rests on the upper end of the core, thereby centering the apparatus likewise at the same time. A particular positioning device would thus no longer be needed. For a highly accurate centering, the shoulder could be provided with a step serving to engage in an annular groove in the upper edge of the opening in the core and corresponding with the upper edge of the opening, so as to permit a totally form-fitting engagement as a result of the corresponding contours of the shoulder and the upper end of the core. To avoid that the engagement is not impeded due to a slight clearance, the side surfaces or flanks being used for the engagement could be made conical, so as to permit an insertion even when the apparatus is not accurately positioned.

The present invention also involves a method for gripping a casting core, in particular a sole core, with the use of the above-described apparatus and which is characterized by the following steps:

To begin with, the core is positioned with its opening preferably directed upwardly or upwardly open, so as to permit the apparatus of the present invention to enter into the opening of the core. After inserting the apparatus, the core is gripped in the interior by actuating the gripping jaws with a predeterminable contact pressure. As regards the accurate actuation of the gripping jaws, the foregoing description relating to the gripping apparatus is herewith incorporated by reference. With the apparatus activated, the core may be raised and inserted into a structural member substantially adapted to the shape of the core, preferably into a cylinder liner, there remaining at least a small clearance between the outside wall of the core and the inside wall of the structural member or the cylinder liner. In order to provide also for a force-fitting connection between the core and the structural member or the cylinder liner, so as to be able to raise or handle the core together with the cylinder liner, the contact pressure already operative on the inside wall of the core is increased to such an extent, until the core presses against the inside wall of the structural member or the cylinder liner as a result of an at least slight elastic deformation, and a frictional engagement occurs between the outside wall of the core and the inside wall of the structural member. In a subsequent step of the method, it is possible to raise or move or handle the entire arrangement and, thus, to also install this arrangement in a core assembly.

It is thus accomplished by the method of this invention that structural components engaging with one another with a clearance, may be raised, moved, or handled without gripping both structural components, namely, in that the structural components are reversibly pressed together or against one another, at least temporarily, from the inside out.

With respect to the method, it is of further advantage, when the structural member or the cylinder liner receiving the sole core is made available by being positioned on a template. Such a predetermined positioning favors an automatic operation, or assists in avoiding expensive sensor arrangements.

The core or sole core may be provided at its upper end with a flange having on its underside a preferably annular or partial recess. Within the scope of a further step of the method, it would likewise be possible to position on the template an annular component, in particular a water-jacket core, which surrounds the structural member or cylinder liner and has preferably an annular cross section, and onto which the flange of the core or sole core is placed while sliding into the structural member or into the cylinder liner. Consequently, in one operation, the sole core would be placed into the cylinder liner, and the water-jacket core surrounding the cylinder liner would be secured. The end of the water-jacket core serving to engage in the annular or partial recess in the flange of the core or sole core could be made in the form of preferably three peripherally arranged feet. Furthermore, the end of the water-jacket core serving to engage the recess in the flange of the core or sole core, in particular the feet being used for the insertion, may be provided with an adhesive before the insertion. This adhesive serves to secure the water-jacket core to the flange of the sole core, the water-jacket core surrounding at a distance the cylinder liner that encloses the sole core.

With respect to applying the adhesive, it will be of special advantage, when recesses or grooves for receiving an adequate amount of adhesive are provided in the free end of the water-jacket core, in particular in the free end of the feet being used for the insertion. This measure prevents an outflow of the adhesive or the glue effecting the connection, and forms a sort of adhesive bearing when the water-jacket core is pushed or pressed in. At this point, it should be specifically noted that it is not absolutely necessary to press the water-jacket core in force-fitting manner into the flange of the sole core, but that it is glued to the sole core in the event of a possibly slight mechanical meshing engagement. A damage to the cores is again effectively avoided.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENT

Figure 2:
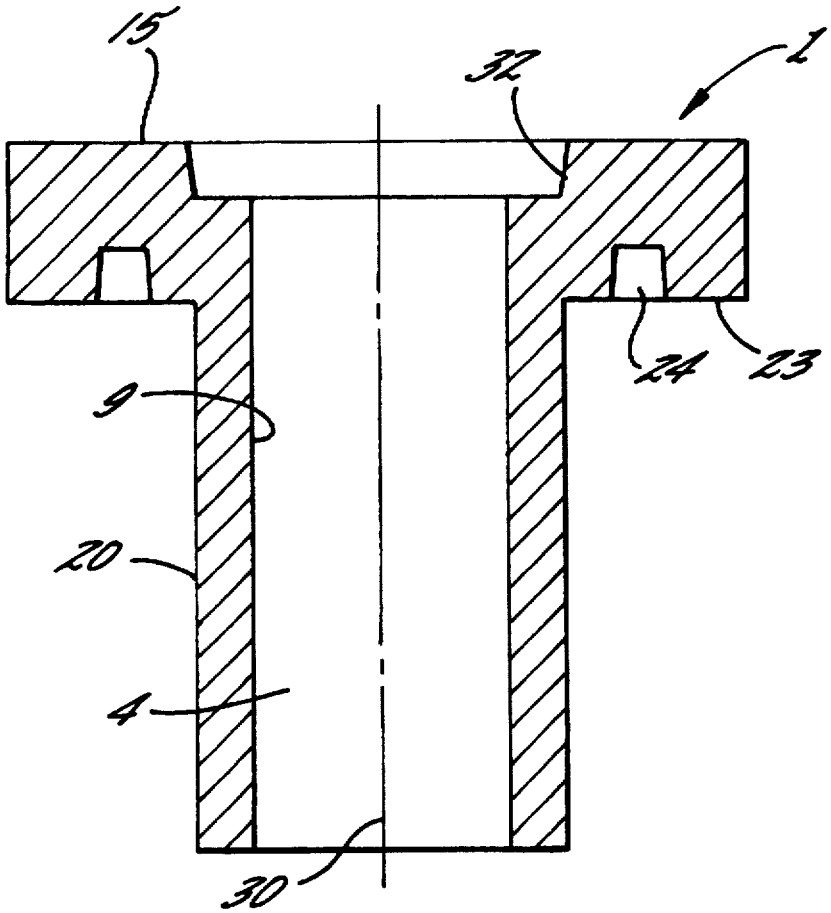
FIG. 2 is an enlarged sectional view of the sole core of FIG. 1 taken along line II—II.
Figure 3:
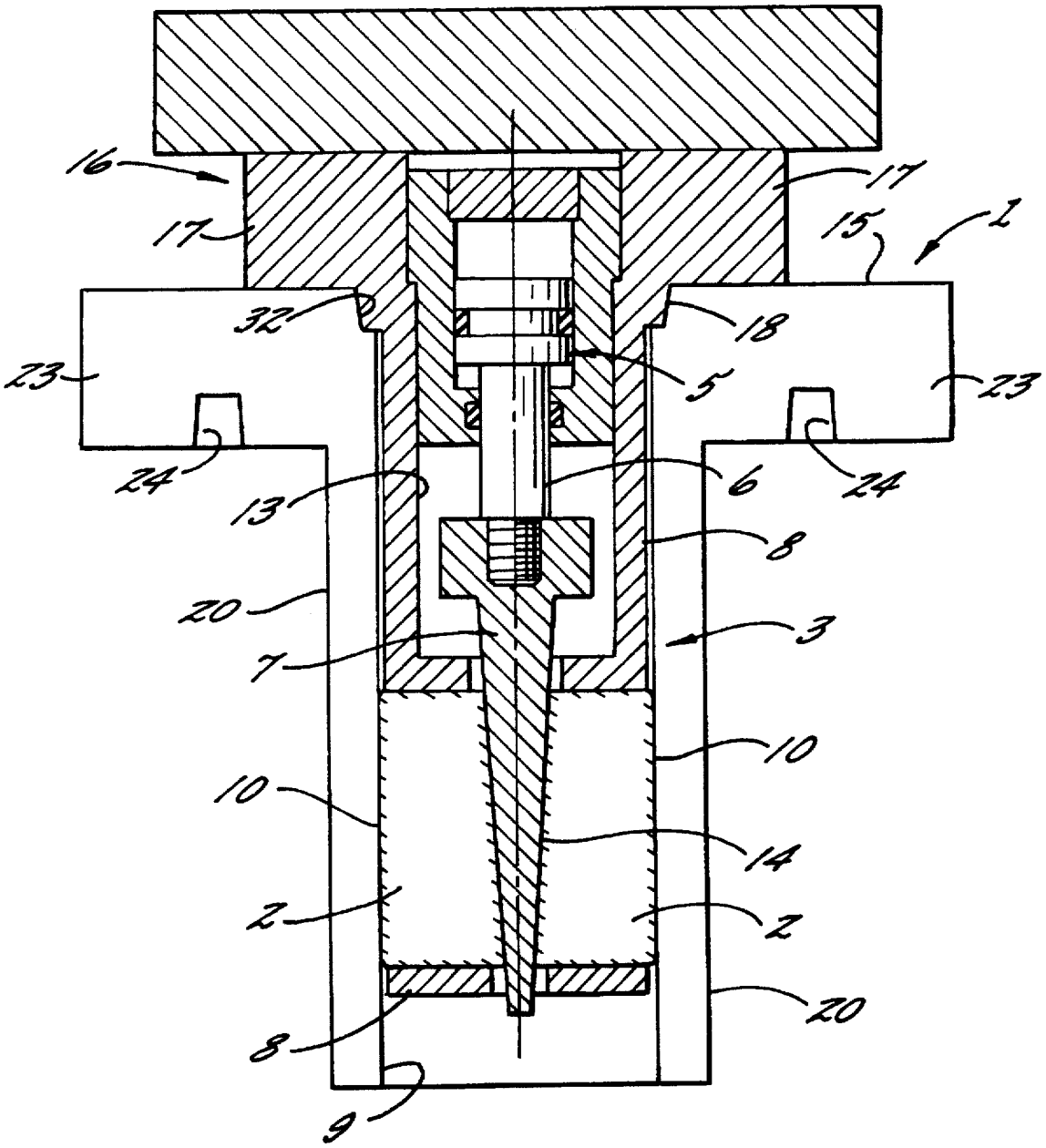
FIG. 3 is a sectional view of the sole core shown in FIGS. 1 and 2 with a gripping apparatus in accordance with the present invention being inserted therein and with the gripping jaws thereof being in their operating position.
Figure 6:
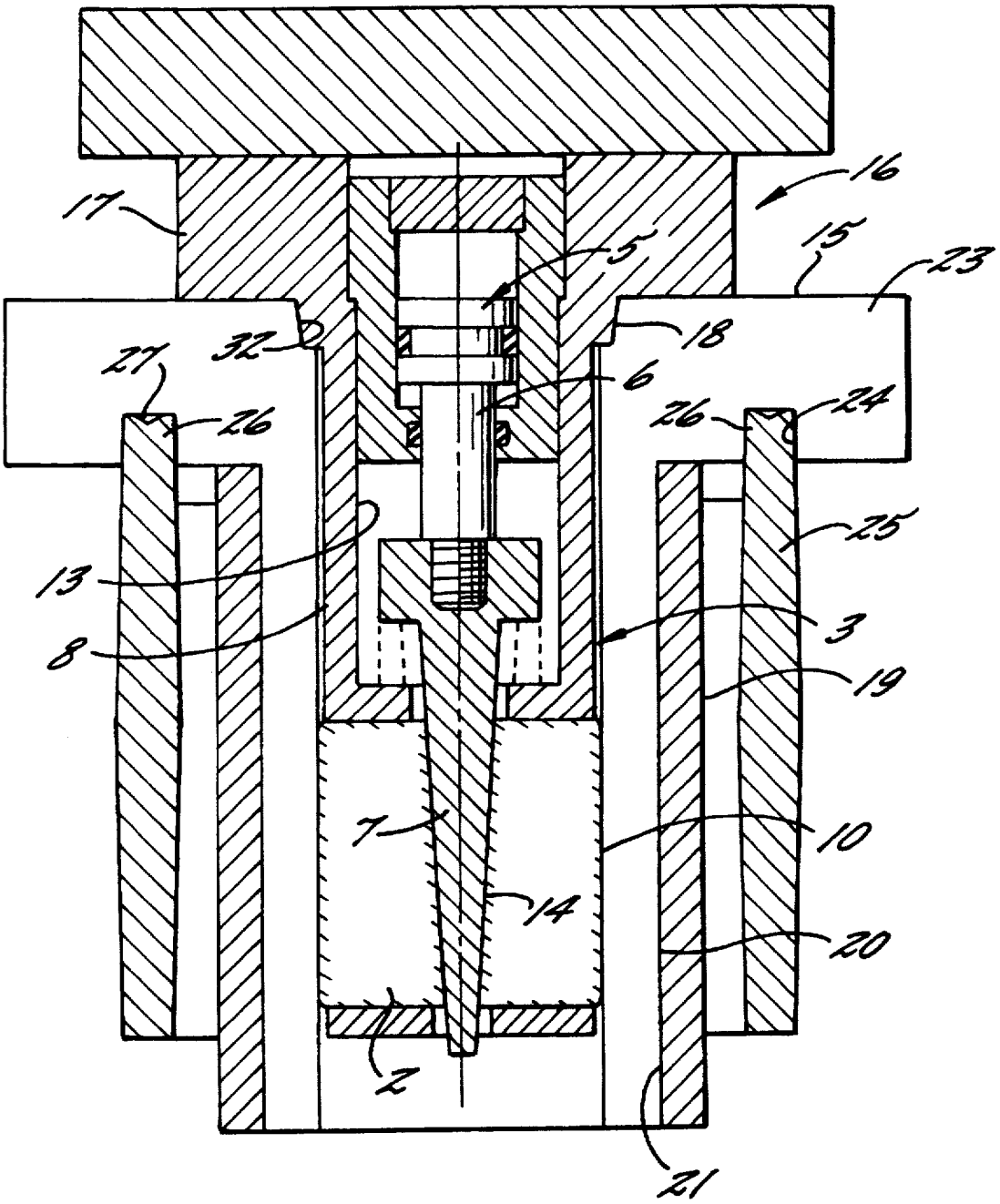
FIG. 6 is a sectional view of the arrangement of FIGS. 4 and 5, together with the sole core of FIG. 3 carried by the gripping apparatus.
Figure 7:
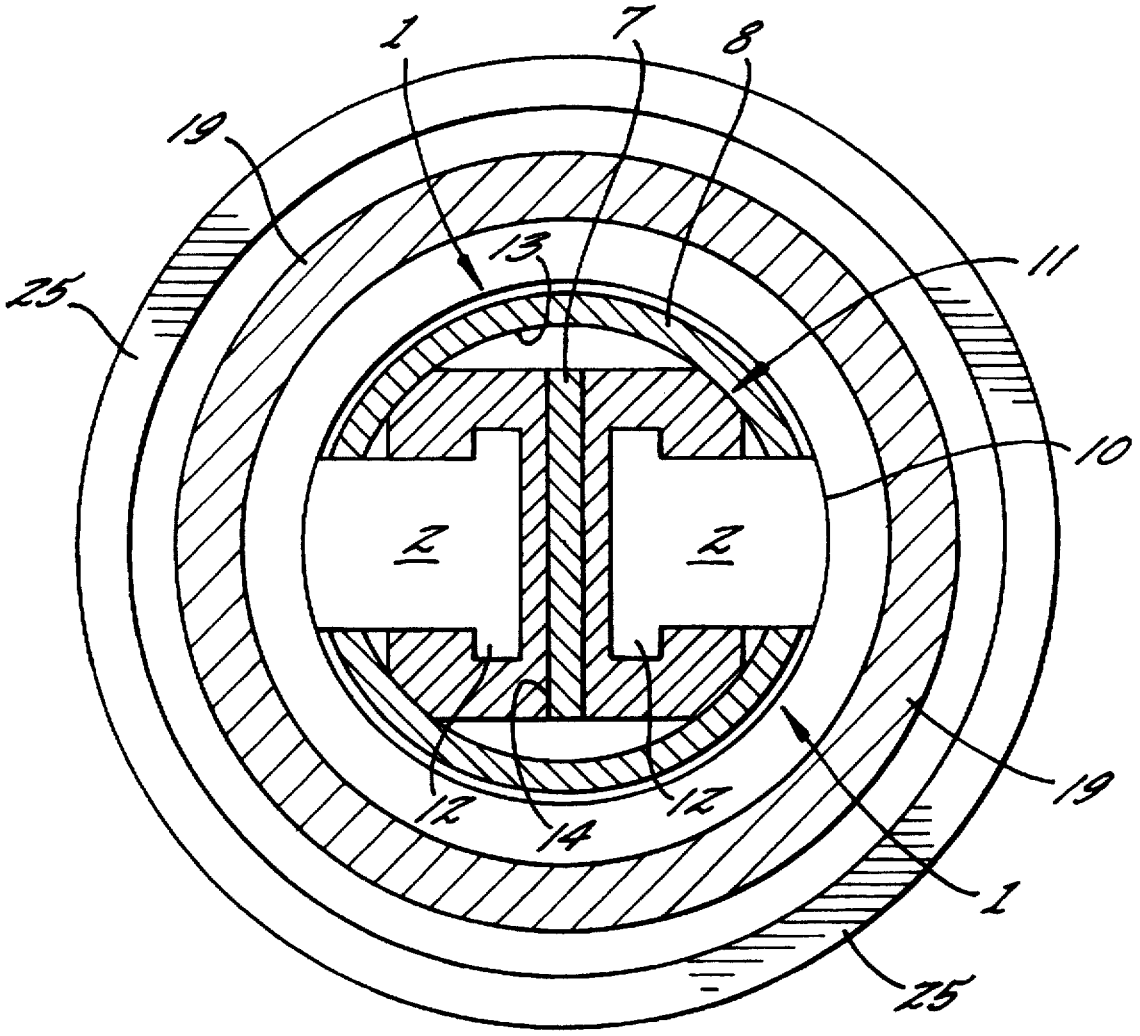
FIG. 7 is an enlarged, schematic bottom view of the subject matter of FIG. 6.

FIGS. 3, 6, and 7 illustrate an apparatus 3 for gripping a casting core in accordance with the present invention, the core being in particular a sole core 1. The sole core 1 includes a tubular portion which defines a central axis 30 (FIG. 2) and a generally cylindrical outside wall 2O, and an opening 4 extends through the tubular portion so as to define a generally cylindrical inside wall 9. The casting core further includes a flange 23 at one end of the tubular portion, which defines an upper surface 15. An annular recess 24 is positioned in the underside of the flange 23, and is best seen in FIG. 2, the juncture between the inside wall 9 and the upper surface 15 includes an annular groove 32.

The apparatus 3 includes a pair of gripping jaws 2 which engage the inside wall 9 of the opening 4 in a form-fitting manner when the apparatus is inserted thereinto.

In the illustrated embodiment, it is important that the contact pressure of the gripping jaws 2 be predeterminable or adjustable. Furthermore, as best seen in FIGS. 3 and 6, the apparatus 3 comprises a cylinder-piston arrangement 5 with an outwardly displaceable piston rod 6 and a clamping wedge 7 fixed thereto and extending between the clamping jaws 2. The cylinder-piston arrangement 5 operates pneumatically.

Further shown in FIGS. 3 and 6 is that the cylinder-piston arrangement 5, clamping wedge 7, and gripping jaws 2 are accommodated in a generally cylindrical support housing 8 for insertion into the opening 4 of sole core 1. The gripping jaws 2 are movable radially outwardly through openings in the housing 8, and in a direction which is perpendicular to the central axis of the housing 8, and which is perpendicular to the direction of movement of clamping wedge 7. The jaws 2 thus move outward in opposite directions toward the inside wall 9 of sole core 1, as a result of moving clamping wedge 7 downwardly in the axial direction.

FIGS. 6 and 7 illustrate that the two diametrically opposed clamping jaws 2 are provided for movement in opposite directions to one another out of housing 8 and in directions toward the inside wall 9 of sole core 1. As can be noted from FIG. 7, the opening 4 has a circular cross section. A contact surface 10 is provided on the outer end of each of the clamping jaws 2 which serves to contact the inside wall 9 of sole core 1, and the surfaces 10 form segments of a common circle which conforms to the circular configuration of the inside wall 9. By means of clamping wedge 7, the clamping jaws 2 can be pressed against a stop 11 defining the displacement of clamping jaws 2. The stop 11 is formed by an extension 12 formed on the side of each jaw facing away from contact surface 1O, and which engages the inside wall 13 of housing 8. Not shown in the Figures is that the clamping jaws are returned into the housing 8 by elastic retaining means when clamping wedge 7 is retracted. The elastic means may for example take the form of a pressurized gas.

As regards the configuration of clamping jaws 2, it is best seen in FIG. 7 that the clamping wedge 7 rests with its wedge surfaces 14 in form-fitting engagement with and displaceably against clamping jaws 2 on their side facing away from contact surface 10.

As can be noted from FIGS. 3 and 6, the apparatus 3 is provided at its upper end 16 with a shoulder 17 serving to contact, at the entry side, the upper surface 15 of sole core 1, and to center the clamping device 3 with respect to the opening 4 and to also define its depth of penetration. This shoulder 17 is further provided with a step 18 serving to matingly engage with the groove 32 in the upper edge 15. The outer side edge of the step 18 narrows so that it may be fitted into the groove 32 of the sole core 1, by a conical cross section, and so that the apparatus 3 is guided with its rear portion comprising shoulder 17 directly into the opening 4 of the sole core 1.

Referring now to FIGS. 1–7, the method of the present invention is described with the use of the above-described gripping apparatus 3.

Figure 1:
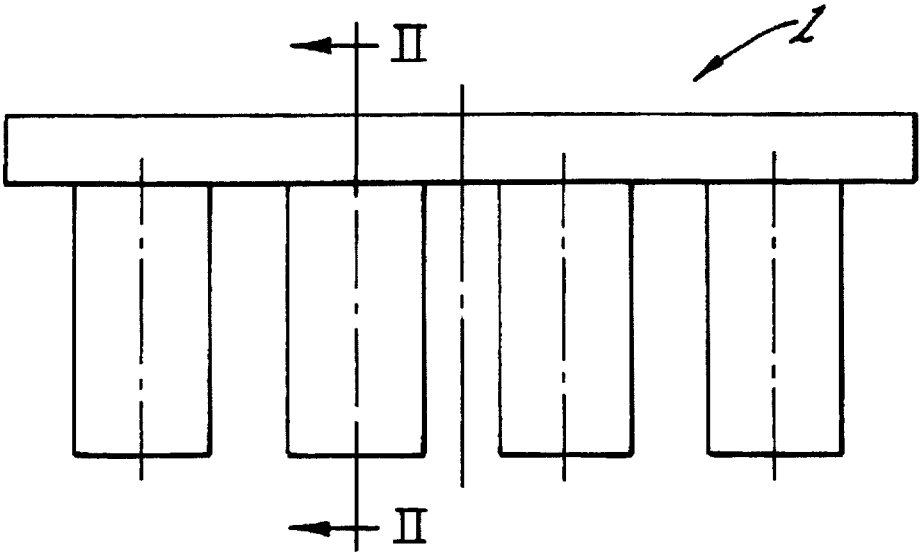
FIG. 1 is a schematic side view of a sole core of the type adapted to be gripped by the apparatus of the present invention.

The method of the present invention relates to gripping and, thus, to handling a casting core, the latter being a sole core 1 in the illustrated embodiment. Handling occurs with the use of the above-described apparatus 3. According to the invention the claimed method comprises the following steps:

In a first step, the core 1 is positioned with its opening 4 being upwardly directed or upwardly open as shown in FIGS. 1 and 2. As shown in FIG. 3, the apparatus 3 is inserted into the opening 4 of sole core 1, it being possible to provide also for several apparatuses 3 in the case of several openings 4. In the next step, the sole core 1 is gripped in its interior, under a predeterminable contact pressure, by actuating the apparatus 3. After actuating clamping apparatus 3, the sole core 1 having been gripped in its interior as shown in FIG. 3, can be easily raised and inserted into a structural member, such as a cylinder liner 19, which is adapted to the shape of sole core 1, but with a slight clearance. Thus the core 1 may be inserted into the liner 19 without excessive pressure between the outside wall 2O of sole core 1 and the inside wall 2 of cylinder liner 19.

In a subsequent step of the method, the contact pressure of apparatus 3 or clamping jaws 2 is increased by a further advance of the clamping wedge 7, until the sole core pushes, as a result of elastic deformation, against the inside wall 21 of cylinder liner 19, and outside wall 20 of sole core 1 is in frictional engagement with inside wall 21 of cylinder liner 19. Thereafter, the entire arrangement can be raised or moved and transported by means of the apparatus 3, or a manipulator carrying same, or the like and, subsequently, be installed, for example, in a core assembly.

Figure 4:
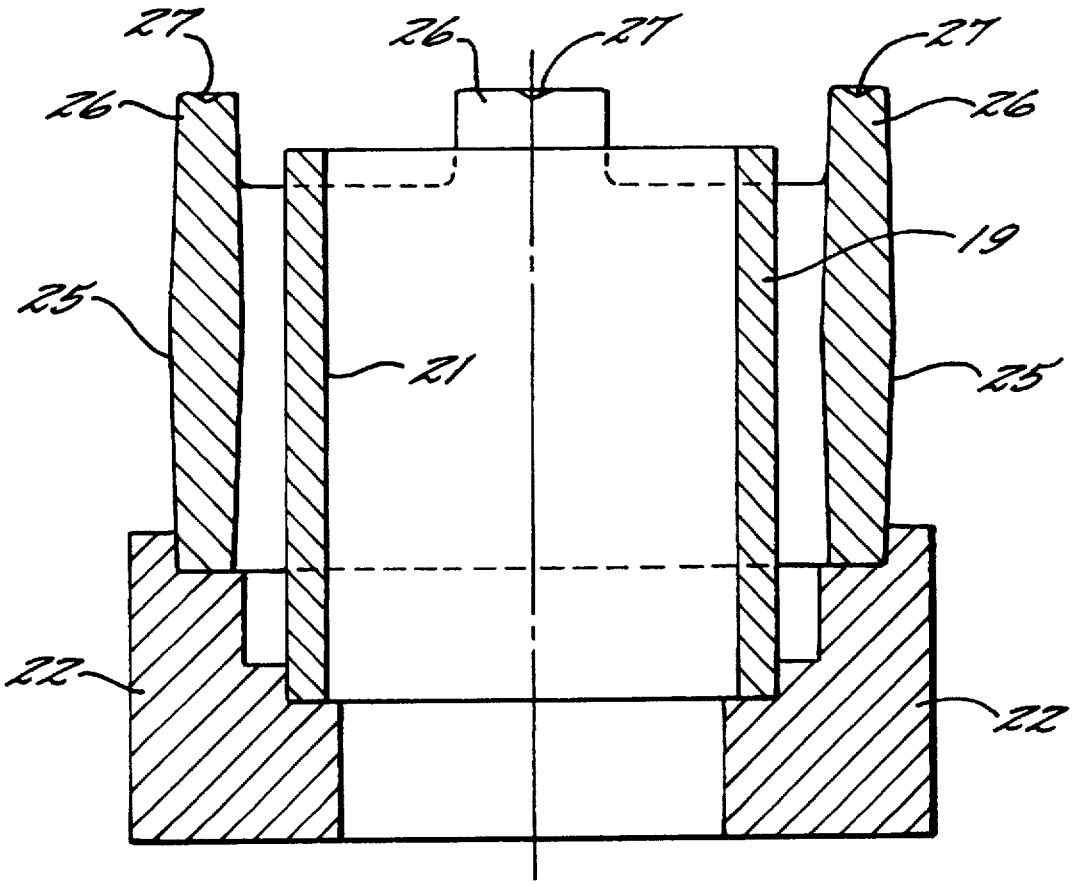
FIG. 4 is a sectional side view of a template carrying a cylinder liner and a water-jacket core.
Figure 5:
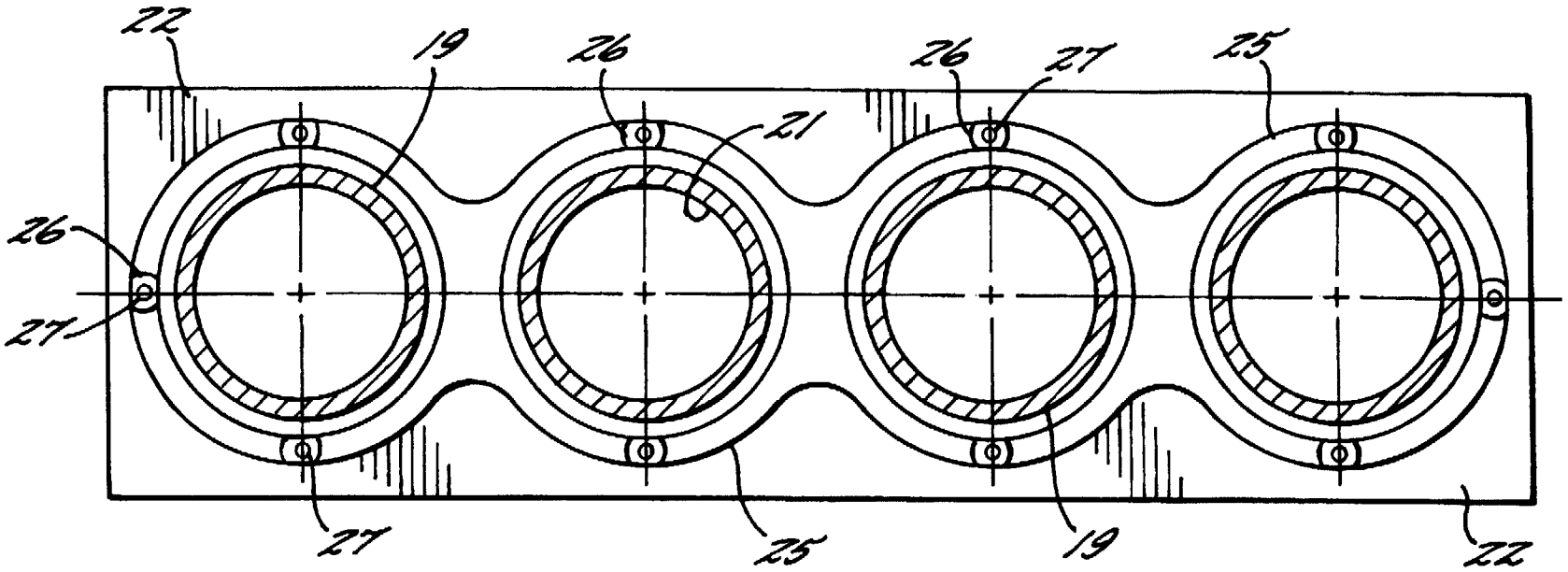
FIG. 5 is a reduced schematic top view of the subject matter of FIG. 4.

As can be noted from FIGS. 4 and 5, the cylinder liner 19 is made available by being positioned on a template 22. Essential is that the sole core 1 be provided with a flange 23 which has a recess 24 arranged in its underside. This recess 24 could be made, for example, in the shape of a circular ring, but may also be made partial in the form of divided circular rings.

As shown in FIGS. 4 and 5, an annular component in the form of a water-jacket core 25 having an annular cross section and surrounding the cylinder liner 19, is kept ready on template 22 for receiving the sole core 1 that is inserted thereon with its flange 23 while being pushed into cylinder liner 19. In the embodiment shown in FIG. 4, the end of water-jacket core 25 serving to engage in the recess 24 of flange 23 of sole core 1 is constructed, at least in its upper end portion, in the form of three peripherally arranged feet 26. The ends of the feet 26 serving to engage in recess 24 of sole core 1 are provided on the upper end side with an adhesive. To receive an adequate amount of the adhesive in question, the free end of the feet 26 are provided with recesses or grooves 27, so that the adhesive or glue can be displaced, and that the insertion of feet 26 into sole core 1 is not obstructed.

Finally, it should be noted that the foregoing embodiment has been described by way of example to merely explain the teaching of the present invention, without however being limited thereto.

I claim:

1. A method of gripping a casting core which includes a tubular portion which defines a generally cylindrical outside wall, and an opening therethrough which defines a generally cylindrical inside wall, and comprising the steps of providing a gripping apparatus which comprises a support housing and a pair of oppositely moveable gripping jaws mounted to said support housing, inserting the gripping apparatus into said opening of said casting core so that the gripping jaws are within said opening, actuating the gripping apparatus so that the gripping jaws engage the inside wall surface of the opening with a predetermined contact pressure and so as to grip the casting core, transporting the gripping apparatus and the gripped casting core to a structural member having an annular peripheral wall which has an inside diameter slightly greater the diameter of the outside wall surface of the casting core, and then positioning the gripped casting core into the structural member so that the tubular portion of the casting core is coaxially disposed in said annular peripheral wall of said structural member, increasing the gripping force between said pair of jaws and said inside wall surface of the casting core so as to cause the tubular portion of the casting core to expand and press against the annular peripheral wall of said structural member, and so as to grip the structural member, and then transporting the gripping apparatus and the gripped casting member and the gripped structural member to a new location.

2. The method as defined in claim 1 wherein said structural member is supported on a template during the steps of positioning the gripped casting core into the structural member and increasing the gripping force.

3. The method as defined in claim 2 wherein an annular component is positioned on said template so as to coaxially surround said structural member during the steps of positioning the gripped casting core into the structural member and increasing the gripping force, and wherein the casting core includes a flange at one end of the tubular portion, with the flange including an annular recess positioned in the underside thereof, and wherein the annular component includes an upper edge which is received in said annular recess in said flange when said gripped casting core is positioned into said structural member.

4. The method as defined in claim 3 wherein the upper edge of the annular component which engages in the annular recess of the flange comprises a plurality of annularly spaced apart feet.

5. The method as defined in claim 4 wherein the upper edge of the annular component which engages in the annular recess of the flange includes an adhesive positioned thereon prior to being engaged in the annular recess.

6. The method as defined in claim 5 wherein the upper edge of the annular component which engages in the annular recess of the flange includes a groove for receiving the adhesive.

7. The method as defined in claim 1 wherein said gripping apparatus further comprises a cylinder-piston assembly which includes an outwardly displaceable piston rod, and a clamping wedge fixed to said rod and extending between said pair of gripping jaws.

8. The method as defined in claim 7 wherein said support housing includes a generally cylindrical portion which defines an axial direction, and wherein said cylinder-piston assembly is mounted in said housing so that said piston rod and said clamping wedge are moveable in said axial direction and said gripping jaws are moveable in opposite directions which are perpendicular to said axial direction.

9. The method as defined in claim 8 wherein said support housing further includes a pair of oppositely directed radial openings and wherein said pair of gripping jaws are mounted so as to extend through respective ones of said radial openings.

10. The method as defined in claim 9 wherein said pair of gripping jaws each include an outer surface which is in the form of a segment of a common circle when viewed in transverse cross section.

11. The method as defined in claim 10 wherein said support housing and said pair of gripping jaws include opposing surfaces which define respective stops for the movement of the pair of gripping jaws in a radially outward direction.

12. The method as defined in claim 10 wherein said clamping wedge includes oppositely facing wedge surfaces which respectively engage the sides of said gripping jaws opposite the outer surfaces thereof in a form-fitting manner.

13. The method as defined in claim 1 wherein said support housing includes a radial shoulder at one end thereof, and wherein the shoulder engages one end of said tubular portion of said casting core during the inserting step.

14. The method as defined in claim 13 wherein said shoulder includes a step positioned to engage said one end of said tubular portion of said casting core, to thereby center the support housing in the opening of said casting core during the inserting step.

* * * * *